US006557377B1

(12) United States Patent
Massari

(10) Patent No.: US 6,557,377 B1
(45) Date of Patent: May 6, 2003

(54) MAGNETICALLY SECURED JEWELRY DISPLAY FRAME

(76) Inventor: Allison Massari, 101 Pinto Dr. East, Edwards, CO (US) 81632

( * ) Notice: Subject to any disclaimer, the term of this patent is extended or adjusted under 35 U.S.C. 154(b) by 0 days.

(21) Appl. No.: 09/488,717

(22) Filed: Jan. 20, 2000

(51) Int. Cl.[7] ..... A44C 25/00

(52) U.S. Cl. ..... 63/23; 63/29.1; 63/29.2; 40/711; 40/765

(58) Field of Search ..... 63/1.11, 1.14, 63/18, 20, 23, 29.1, 29.2, 900; 40/711, 765

(56) References Cited

U.S. PATENT DOCUMENTS 2,316,225 A * 4/1943 Hoffman et al. ..... 63/29.1
2,433,711 A * 12/1947 Schober et al. ..... 63/14.6
2,785,490 A * 3/1957 Fabry ..... 40/711
3,298,124 A * 1/1967 Jahn ..... 40/711
3,553,872 A * 1/1971 Ebner ..... 40/711
3,553,873 A * 1/1971 Weston ..... 40/711
4,122,619 A * 10/1978 Kruger ..... 40/365
4,583,309 A * 4/1986 Kane et al. ..... 40/711
5,167,085 A * 12/1992 Yang ..... 40/711
5,193,360 A * 3/1993 Lovegrove ..... 63/15
5,269,083 A * 12/1993 Vampatella et al. ..... 40/711

* cited by examiner

*Primary Examiner*—J. J. Swann
*Assistant Examiner*—Andrea Chop
(74) *Attorney, Agent, or Firm*—Charles E. Lylas, Jr.

(57) ABSTRACT

A small frame apparatus which is suitable for use with a necklace or other item of jewelry in which a small display, such as a miniature work of art or photograph, may be secured. The display is adhered to a small metallic plate which may be inserted into the frame and then held in place by a magnet, which is mounted proximate to and rearward of the metallic plate.

9 Claims, 7 Drawing Sheets

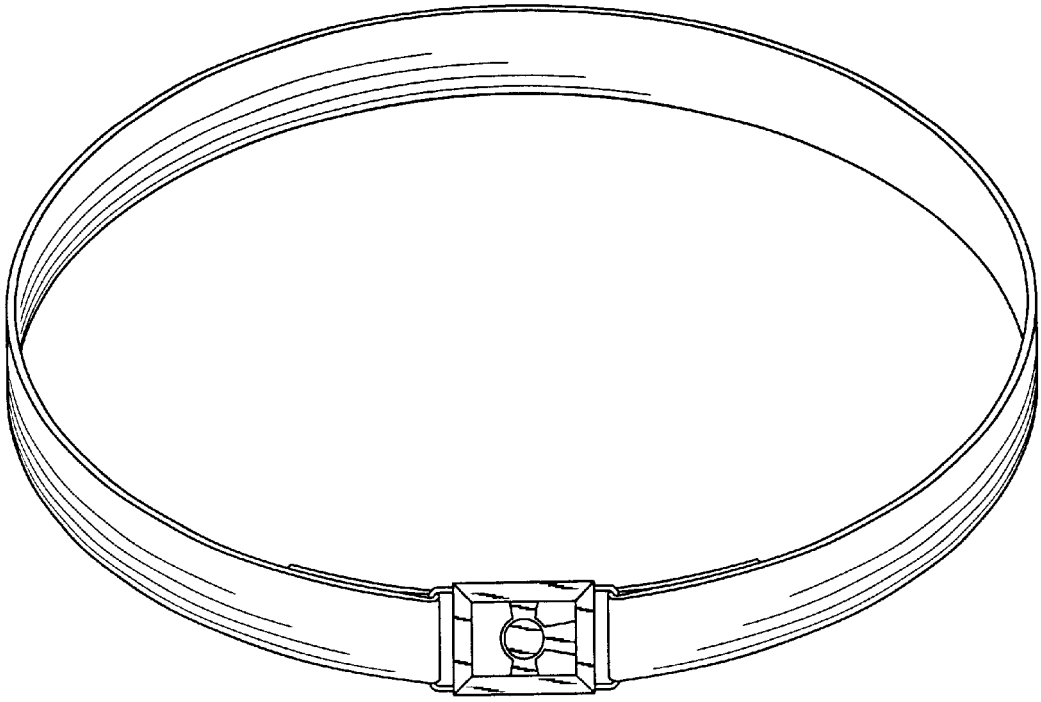
FIG. 15
FIG. 16
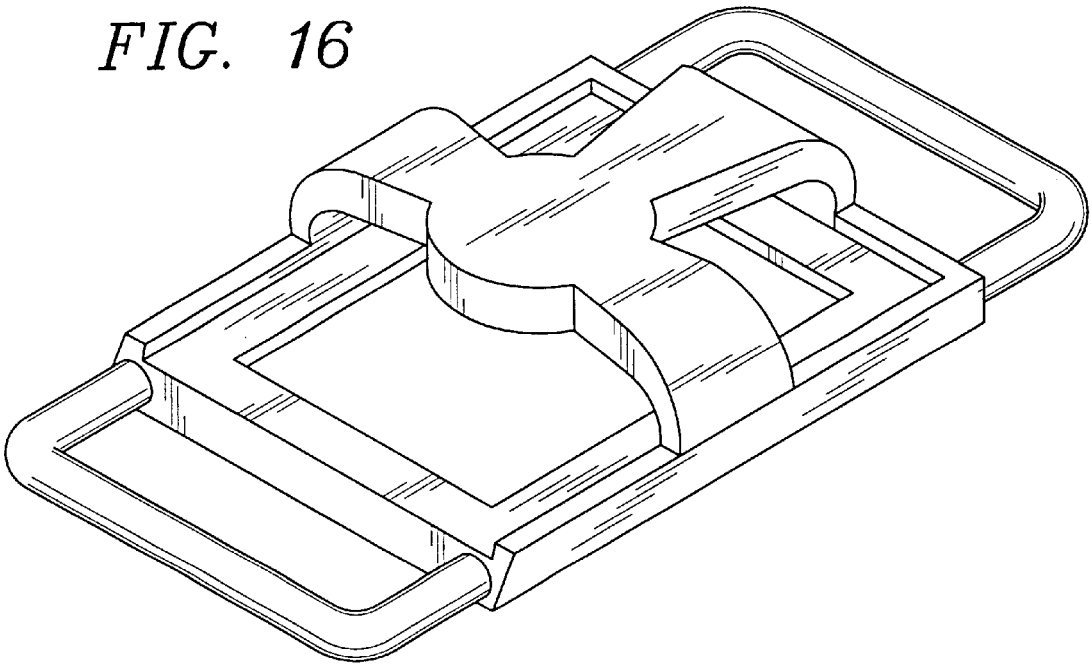

MAGNETICALLY SECURED JEWELRY DISPLAY FRAME

FIELD OF THE INVENTION

The invention relates to jewelry items, in particular necklaces and necklace accessories.

BACKGROUND OF THE INVENTION

A very common item of jewelry is a necklace. A necklace generally comprises a chain or line made of some precious metal, or it could be a strand of beads of some precious stone or jewel, such as pearls.

Frequently, necklaces are further adorned with accessories of various kinds. Such accessories could include a precious gem or other display which is allowed to hang from the necklace and affixed with a loop or attachment of some kind. One popular necklace accessory is a cameo. Additionally, necklace accessories often include a means of displaying a small photograph in a frame. The necklace itself may be made of gold or silver and have substantial value without an accessory. It is not uncommon that the same necklace is used with a variety of different necklace accessories.

Magnetic fields and magnetic implements are often used to secure small display items to a display frame. Magnetism is advantageous as an adhesive because it does not require adjustment or tools nor does it require the use of chemicals which may be difficult to work with or dangerous. Magnetism is also substantially unaffected by the elements or moisture. It is reliable and simple to work with. Finally, objects adhered by magnetism may be easily removed and replaced or be substituted with another object which is of magnetic attraction.

While the display and securing of larger pictures and displays may not be satisfactorily and simply accomplished with magnetism alone, smaller items, such as those which would be appropriate for display in a jewelry accessory, could be adequately secured and appropriately displayed with a magnetic field as the sole means of adhesion.

With respect to the means of framing works of art or other items for display, a number of patents have been issued which in some manner incorporate the use of magnetism in order to achieve an appropriate display. For instance, in U.S. Pat. No. 5,301,444, issued to Horiuchi on Apr. 12, 1994, a marine display incorporates a rotating magnet in order to cause an animated fish to make movements which assimilate the actions of a natural fish. A background plate in the housing behind the liquid vessel imparts a marine-like appearance to the display, but is not used with the magnet.

In U.S. Pat. No. 4,979,323, issued to Wenkman on Dec. 25, 1990, a frame with an integral outer margin and a back plate to mount a picture, photograph or certificate. However, the magnet in Wenkman is used to mount the frame assembly to some other vertical surface and not for the purpose of achieving security of the displayed photograph, certificate or other item. In particular, Wenkman mentions the magnet as useful for a refrigerator Wenkman, when used with a magnet, depends upon a metallic mounting surface.

U.S. Pat. No. 5,186,631, issued to Okutsu on Feb. 16, 1993, incorporates a magnetic display panel which is fixably mounted. In Okutsu the display itself is magnetic and magnetism is used to both create and erase the display within the panel and not to mount the display.

Finally, U.S. Pat. No. 5,075,991, also issued to Wenkman on Dec. 31, 1991, again, the magnet is used to mount the frame assembly upon a vertical surface rather than to secure a work of art within the frame. Wenkman 1991 comprises an improvement in the frame assembly and teaches no new use of the magnet.

What is not provided in the prior art is a frame assembly in which magnetic energy may be used to secure and hold a work of art within a frame. In particular, such has never been applied to a necklace or other item of jewelry. It would be useful to devise an item of jewelry in which magnetism could be used to secure a work of art within a small frame and allow for the display of a variety of art items or other small displays.

SUMMARY OF THE INVENTION

The Inventor has overcome the shortcomings of the prior art by devising a necklace accessory and necklace combination accessory which uses magnetism as the sole source of adhesion of a small display item to be incorporated into the jewelry. Generally, the invention comprises an attractive and lightweight display frame which is adapted to frame an art or display plate. The art or display plate is made of a substance which will sense the attraction of a magnetic field and be held in place by such magnetic field.

The primary embodiment of the apparatus comprises a four-sided frame, with one of the sides being open to allow a magnetically-backed display of art to be slid or placed in and out very easily and can be sufficiently adhered to the frame by a magnetic field from a magnet positioned within the frame member to withstand reasonable movement and jostling. The display frame is further adapted with a means of securing it to a necklace chain and may be made in a variety of shapes.

It will be seen that the principles of the present invention may be practiced with a display frame manufactured in a variety of sizes and shapes. All that is required is a frame which will provide a channel into a display plate and then may be snugly fit or slid, into a channel which is supported, or blocked, on a bottom side, and in which a magnet is positioned so as to be sufficiently strong and proximate to the display plate to hold it in place.

It is, then, an object of the present invention to provide a jewelry display frame in which standard sizes of a metallic display with art or other displays placed and adhered on a front side and may be easily inserted and removed and held into place by a magnet positioned behind the frame member.

It is a further object of the present invention to provide such a display frame which uses magnetism as its sole source of adhesion.

It is a further object of the present invention to provide such an assembly which may be easily and attractively affixed upon a necklace line.

It is a further object of the present invention to provide such a magnet frame member which may be made with a variety of ornamental decoration.

It is further object of the present invention to provide a frame member which incorporates the principles of the present invention with displays which may be of a suitable regular shape.

Other features and advantages of the present invention will be apparent from the following description in which the preferred embodiments have been set forth in conjunction with the accompanying drawings.

BRIEF DESCRIPTION OF THE DRAWINGS

In describing the preferred embodiments of the invention reference will be made to the series of figures and drawings briefly described below.

FIG. 15 depicts the apparatus used as a belt buckle.

FIG. 16 depicts the apparatus in detail as used with the belt buckle in isolation.

Figure 1:
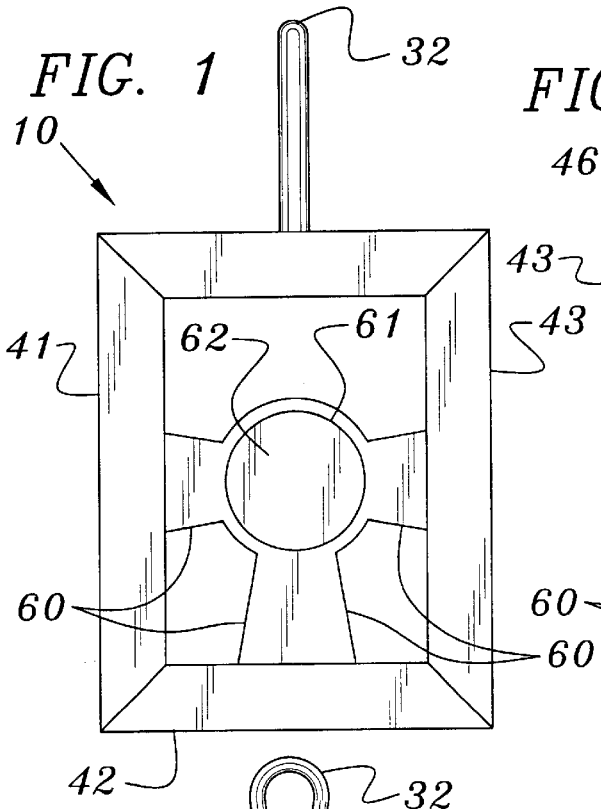
FIG. 1 depicts a frontal view of the necklace accessory apparatus.

While certain drawings have been provided in order to teach the principles and operation of the present invention, it should be understood that, in the detailed description which follows, reference may be made to components or apparatus which are not included in the drawings. Such components and apparatus should be considered as part of the description, even if not included in such a drawing. Likewise, the drawings may include an element, structure, or mechanism which is not described in the textual description of the invention which follows. The invention and description should also be understood to include such a mechanism, component, or element which is depicted in the drawing but not specifically described.

DETAILED DESCRIPTION OF THE PREFERRED EMBODIMENT

Reference will now be made in detail to the present preferred embodiment of the invention, an example of which is illustrated in the accompanying drawings. While the invention will be described in connection with a preferred embodiment, it will be understood that it is not intended to limit the invention to that embodiment. On the contrary, it is intended to cover all alternatives, modifications, and equivalents as may be included within the spirit and scope of the invention defined in the appended claims.

Figure 12:
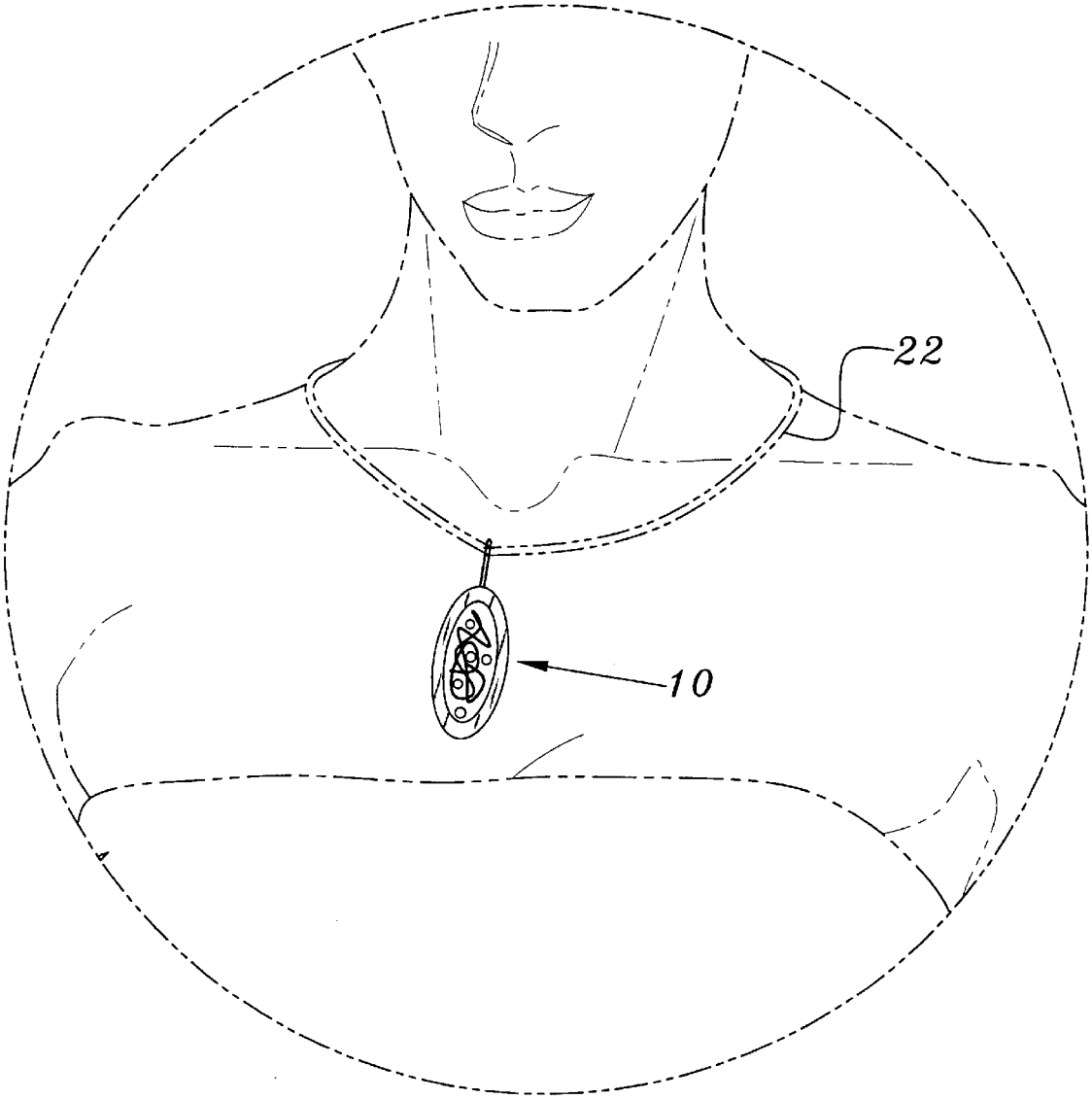
FIG. 12 depicts a necklace adapted with an elliptical frame according to the present invention.

Making reference to FIG. 1, it can be seen that the preferred embodiment of the present invention generally comprises a small frame (10) which is capable of being slidably fastened to a necklace chain (not depicted in FIG. 1, but (21) of FIG. 12) by means of a hook or loop (31). The frame portion (10) of the assembly generally comprises three closed sides (41, 42, 43) and an open side (44).

Figure 2:
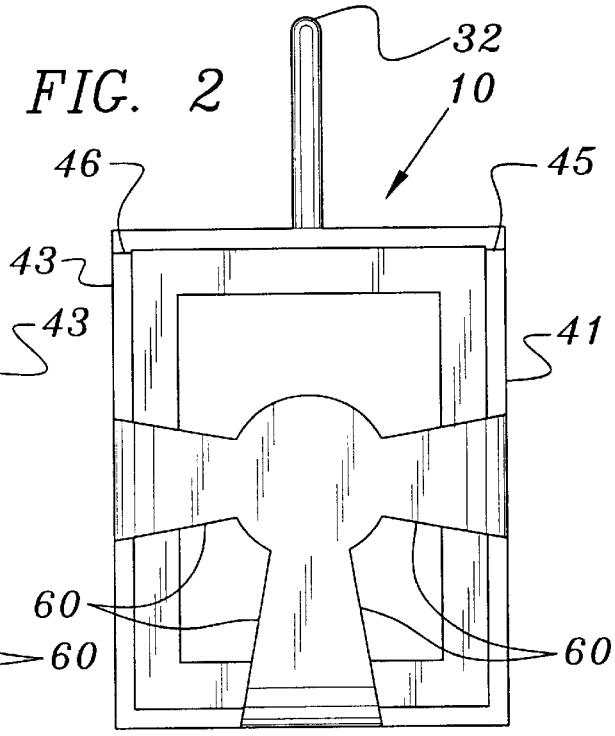
FIG. 2 depicts a rear view of the necklace apparatus.
Figure 3:
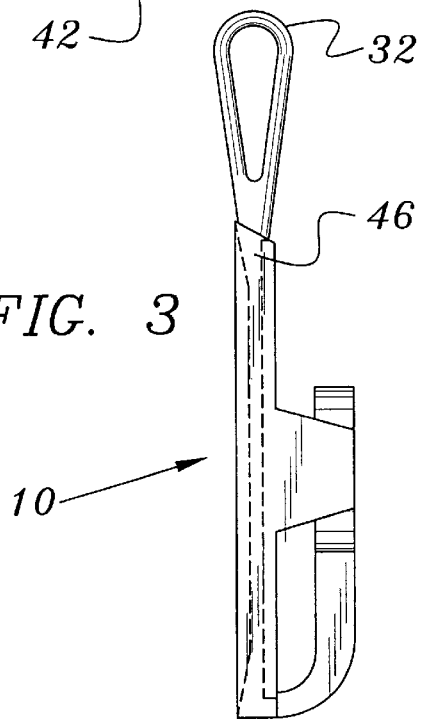
FIG. 3 depicts a side view of the necklace apparatus assembly enabling the relative positions of the various portions of the display frame.
Figure 4:
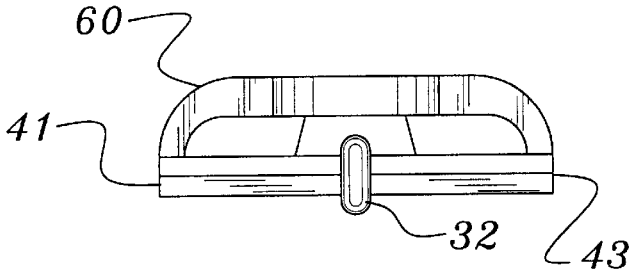
FIG. 4 is a top view of the necklace accessory apparatus.
Figure 5:
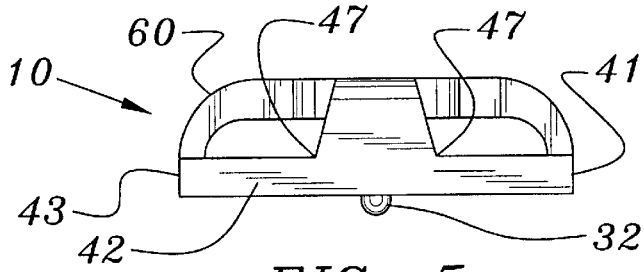
FIG. 5 is a bottom view of the necklace accessory apparatus.

Making reference to FIGS. 2 and 3, it can be seen that the closed sides (41,43) are adapted with slots (45,46) which further serve as channels through which a rectangular object can be easily slid within and without provided that it is not too thick to fit within the channels or slots.

The bottom side (42) is flat and has at least a portion (47) protrude directly back from the front (46) of the frame (10). This protruding portion (47) must have an upper surface (48) which will be of sufficient strength and rigidity to stop and hold the display plate (50).

Figure 6:
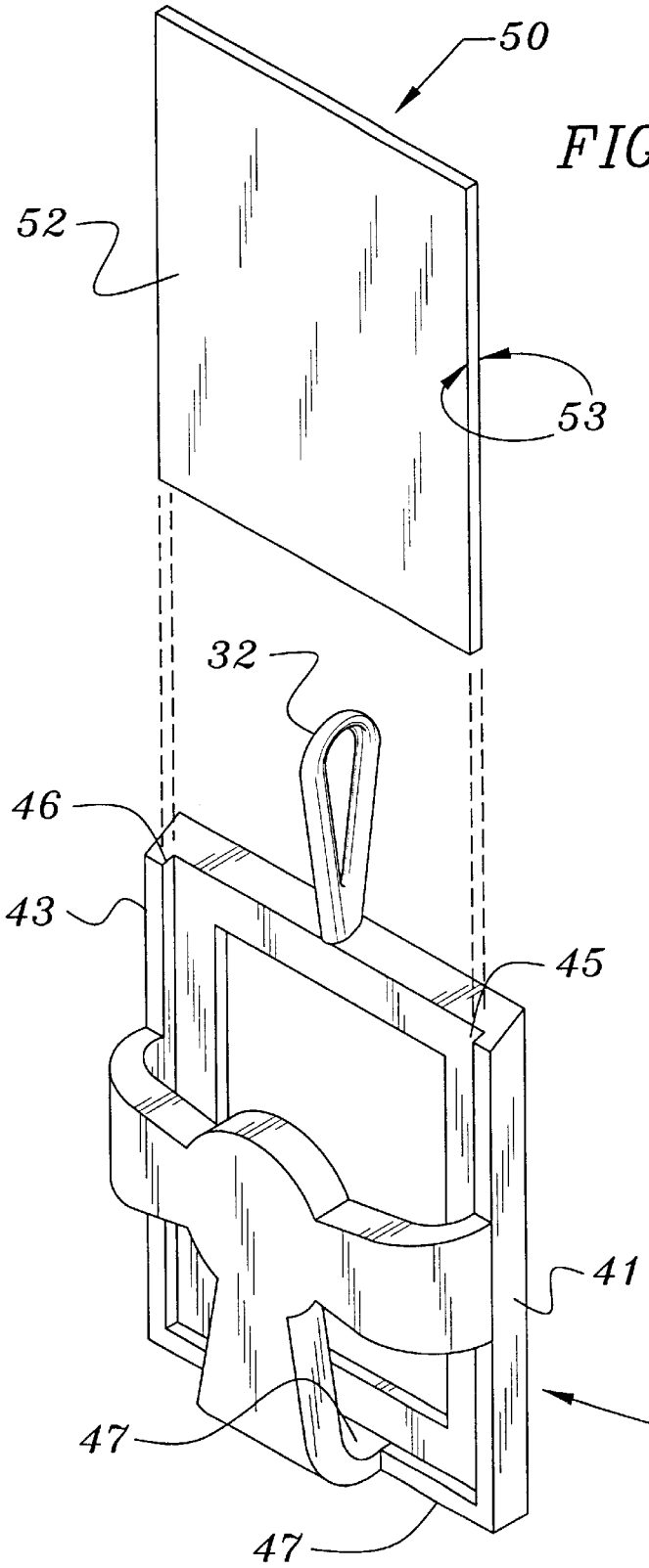
FIG. 6 depicts the entire assembly from the rear with the work of art in position for insertion and also shows the path for insertion.
Figure 7:
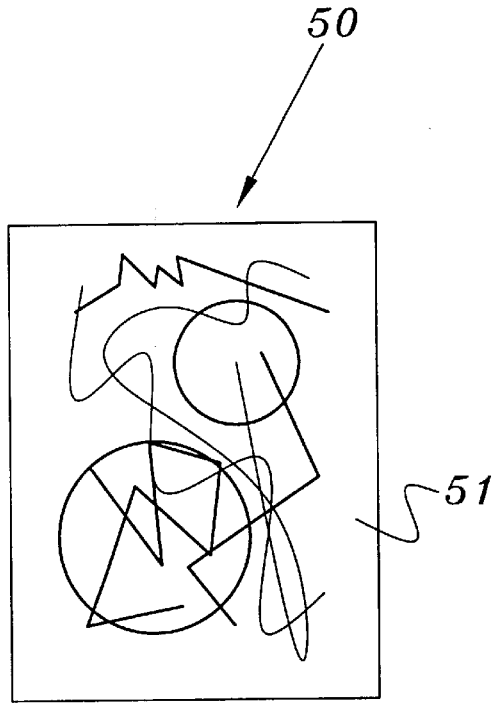
FIG. 7 depicts a front display of a sample work of art.

Making reference to FIGS. 6 and 7 it can be seen that the invention further comprises a metallic display member (50) which comprises a front side (concealed by art display) with a display or work of art (51) and an exposed metallic back side (52) which is made of a material, such as iron, which will experience attraction in a magnetic field. The display member (50) will further be of a thickness (53) to ensure both support for the display (51) and the capacity for magnetic attraction. The work of art (51) may be, by means of a non-magnetic adhesive (not depicted) which is securely fastened to the front of the metallic display member (50). It may further be protected or enhanced by means of (concealed by (51)) a clear coat to protect the integrity of the display (51) and to ensure a permanent and secure junction with the magnetic display member (50).

In the primary embodiment of the invention, this metallic display member (50) is made of a properly sized rectangular shape so that it may be slid within the sliding channels (45, 46) on the sides (41, 43) of the frame (10) down into the frame (10) fully until the bottom (54) of the art display (50) makes contact with the upper surface (48) of the protruding bottom portion (47) of the frame (10). The bottom protruding member (47) and the side channels (45, 46 may, but need not, be joined by magnetic fastening member (60) which further comprises a cavity (61) which houses a magnet (62). The magnet (62) should radiate a sufficiently intense magnetic field (63) so that the metallic display member (50), when slid within the channels (45, 46) down to the protruding bottom portion (47) of the frame (10).

If the display member (50) frame is manufactured of an appropriate material, such as stainless steel or another iron core material, the magnetism of the magnetic member (62) will be sufficient to hold the display member (50) in place throughout normal movements of a person but will not be of such strength to prevent the wilful griping of the art work to remove the art work from the frame when a new display is desired. Of course, the size of the metallic display member (50) must conform to the channels (45, 46) and the magnetic fastening member (10) must position the magnet (62) sufficiently close to the display member (50) back side (51) to ensure good magnetic communication.

This would enable a person to store a variety of art works so that, as often as desired, the jewelry item display may be changed to reveal a new pattern, picture, or other desired display.

The secure connection between the metallic display member (50) and the magnet (62) should by of sufficient strength to resist disturbance from normal jostling or body movements. It can be seen that it would not be affected by rain or other exposure to the elements, such an item of jewelry would be satisfactory for any normal indoor activity and a variety of outdoor activities.

Variations of the present apparatus are possible in keeping within the spirit and scope of the present invention. For instance, the magnetic fastening member (60) can join the frame (50) from any or combination of sides (41, 42, 43) as long as it positions the magnet (62) properly and does not interfere with or block the path of the metallic display member (50) through the channels (45, 46). This could result in a more lightweight apparatus.

Additionally, the frame (10) could be adapted with a clear plastic or glass cover across the front to offer some protection from the elements to the art display (51). Of course, the frame could be adorned with a variety of external displays and designs, as long as within the frame the appropriate channels are included and left unobstructed.

Figure 8:
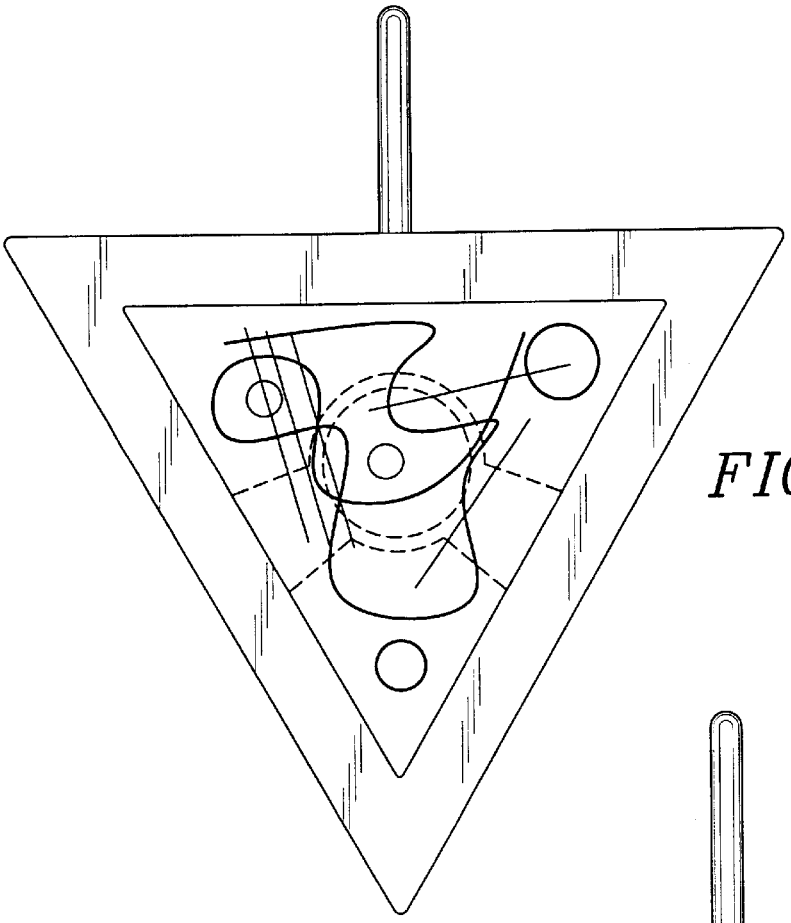
FIG. 8 depicts a triangular frame according to the principles of the present invention, viewed from the front.
Figure 9:
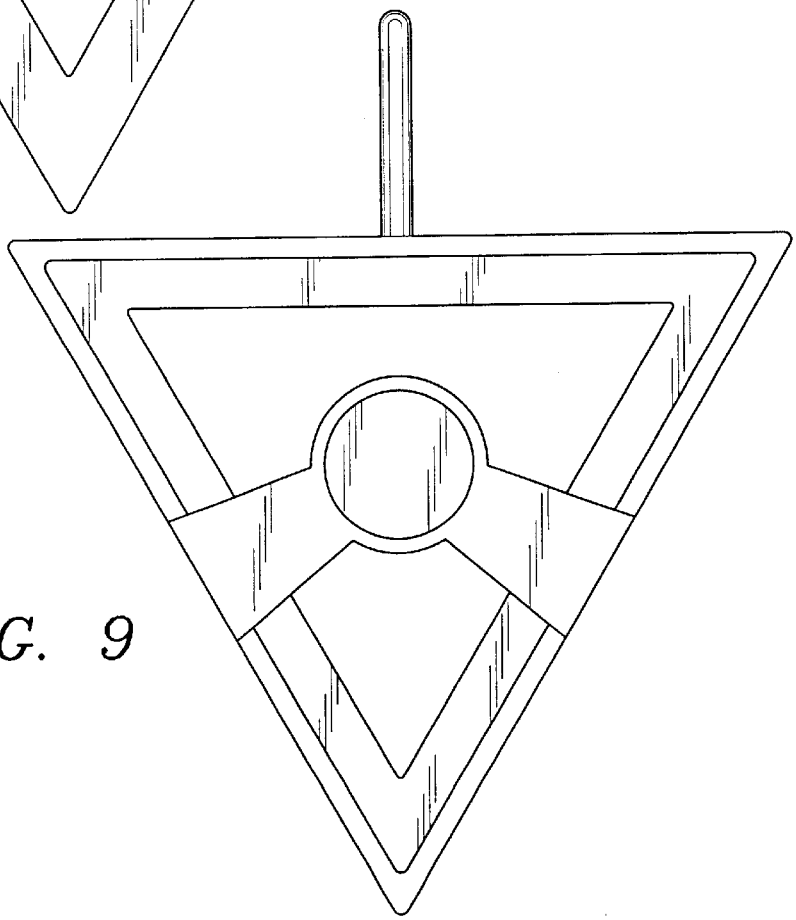
FIG. 9 depicts the triangular frame of FIG. 8 viewed from the rear.

Additionally, as depicted in FIGS. 8 and 9, a triangular frame member (70) could be used. In that case the bottom (77) of the triangular display would be a point and the top (71) would be open. In the triangular alternative embodiment the magnetic mounting member (72), (just as in the primary rectangular embodiment) could be fixed to any one or more portions of the frame (74, 75) as long as it does not interfere with insertion of the display member (76).

Figure 10:
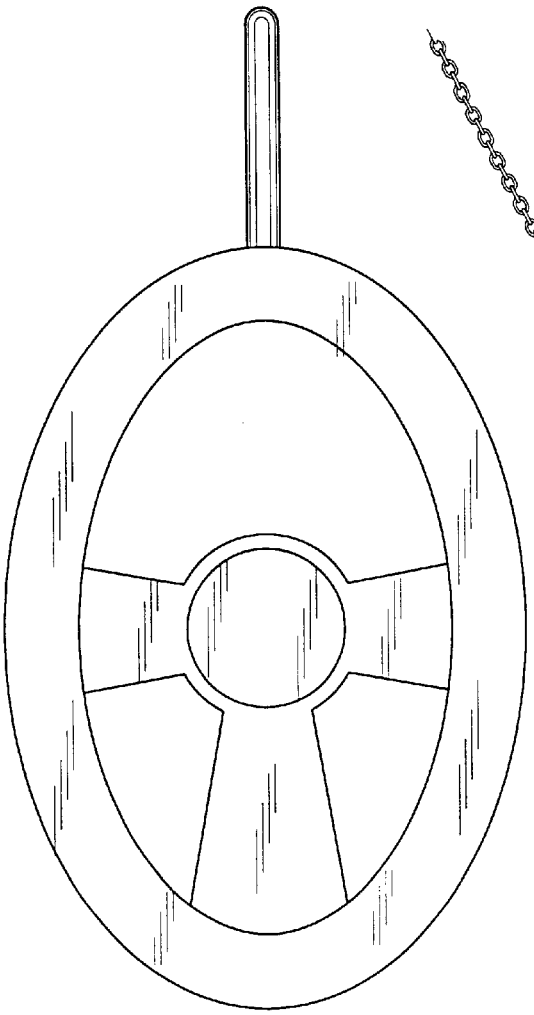
FIG. 10 depicts an elliptical frame according to the present invention which is viewed from the front.
Figure 11:
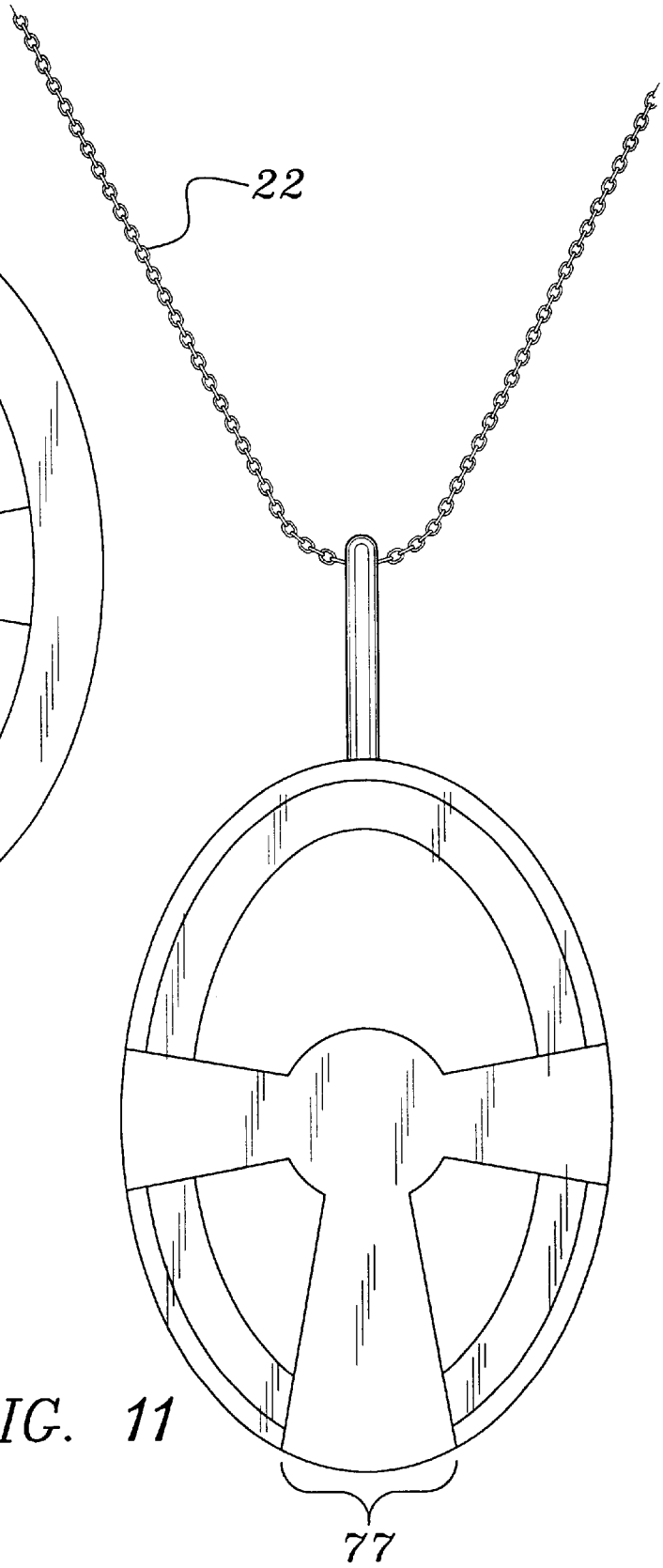
FIG. 11 depicts the elliptical frame according to the present invention which is viewed from the rear.

Making reference to FIGS. 10 and 11 it should be noted that, an elliptical member (80) would also be satisfactory as long as an elliptical display member (not depicted) which would fit within is used and would be supported by a bottom portion (87). Such an elliptical shape would still permit a work of art to be slid within and without with no problem and would be secured at the bottom in order to avoid the force of gravity from sliding the work of art out. The magnetic mounting member (82) could again be fixed to any portion of the frame (83) as long as it did not interfere with insertion of the display member.

Figure 13:
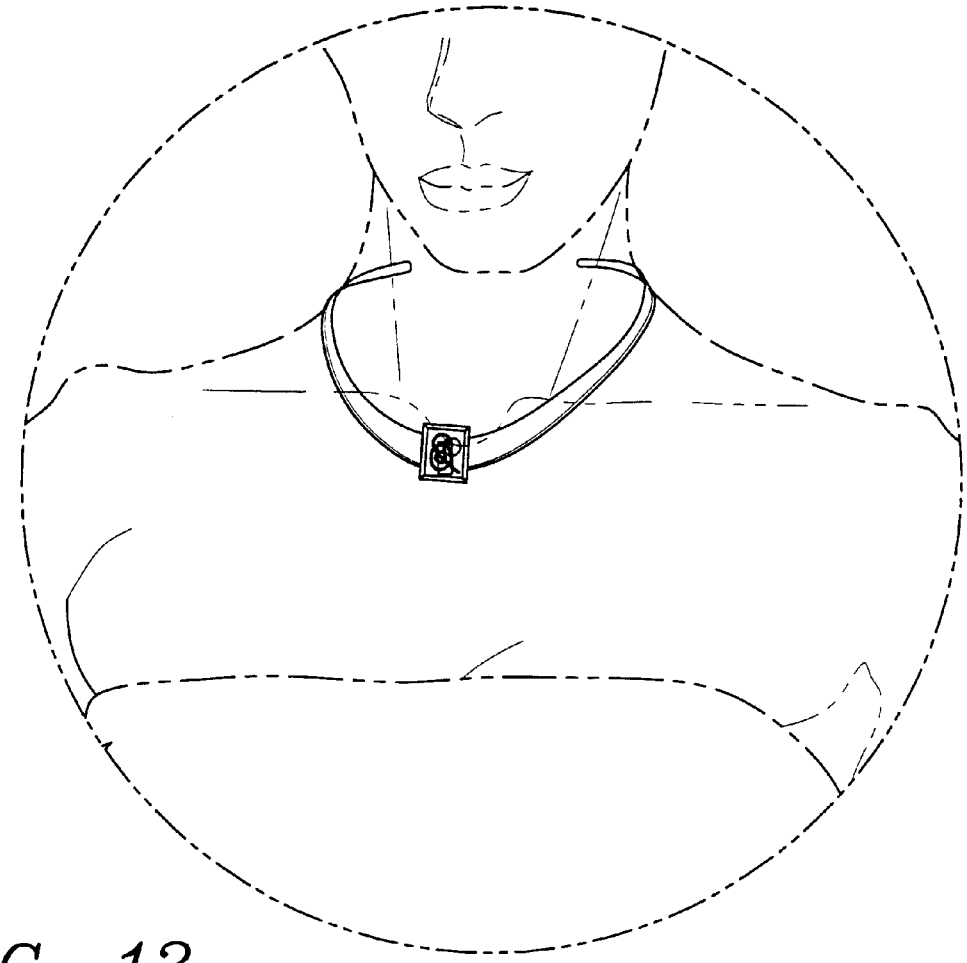
FIG. 13 depicts the apparatus as incorporated in a rigid necklace.
Figure 14:
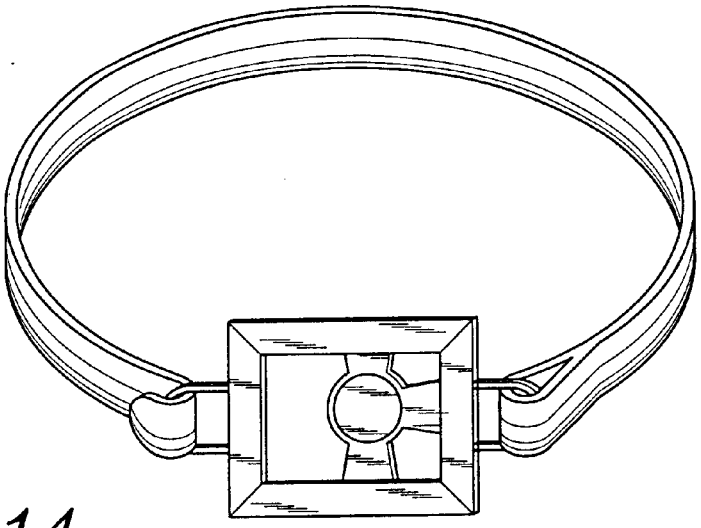
FIG. 14 depicts the apparatus as used with a rigid bracelet.

It should also be considered that the frame apparatus, while described as suitable for use with a necklace, may also be used with other items of jewelry. Additionally, the device could be, by removing the loop, adapted for integration into a ring or more rigid bracelet or necklace, as depicted in FIGS. 13 and 14. Also the same basic frame apparatus taught here could be used on a belt buckle, as depicted in FIGS. 15 and 16. Since such alternative embodiments capture the essential elements of the primary embodiment, they should be seen as keeping within the spirit and scope of the present invention.

FIG. 13 depicts a rigid necklace within which the frame according to the present invention is integrally incorporated. Such could be accomplished with a variety of styles of necklaces. What is important is that the frame is equipped with a means of sliding the display panel within and out from the display frame and is equipped with an appropriately positioned magnetic mount. FIG. 14 depicts the adaptation of the apparatus to a bracelet and shows an empty frame so that the magnetic mount can be better viewed.

FIG. 15 shows the positioning of the apparatus within a belt buckle and FIG. 16 shows a close-up view of the buckled itself, from the back, with the mount in place. Having shown the principles of the invention in great detail and having further shown its general application to a variety of jewelry and apparel items, it can be seen that the device is applicable to a number of such other items, which may not have been specifically described, without departing from the spirit and scope of the present invention. The importance of FIG. 16 is in showing how all of the integral, or rigidly mounted, embodiments incorporating the principles of the invention may be best achieved although, as has been described, the magnetic mount and support structure may be accomplished in a variety of forms as long as an insertion and withdrawal path for the display frame is provided and the magnetic member is securely positioned in close proximity to the display frame position.

Further modification and variation can be made to the disclosed embodiments without departing from the subject and spirit of the invention as defined in the following claims. Such modifications and variations, as included within the scope of these claims, are meant to be considered part of the invention as described.

What is claimed is:

1. Apparatus for securely framing and displaying miniature ornamental or pictorial displays within small items of jewelry, the apparatus comprising;

a planar and rectangular display plate, said planar and rectangular display plate having a front surface upon which an ornamental or pictorial display may be fixed and a rear surface, said rear surface comprised of and exposing a material which is reactive with and attracted to a magnetic field, said display plate being further adapted with left and right sides and upper and lower sides;

a rectangular frame member, said frame member further comprising two side frame members and a base frame member, said side frame members being positioned to permit the said left and right sides of said display plate to be snugly slid within frame member side channels along the length of each said side frame member from outside the frame member to a point within the frame member so that said lower side of said display plate rests against said base frame member and said left and right sides of said display plate are held in position within said frame member by said side frame members;

said frame member being further adapted with an open front portion, said open front portion being adapted to permit the viewing of the said front surface of said planar and rectangular display plate and being adapted with a mounting member, said mounting member being adapted with a source of magnetic radiation positioned so as to create a magnetic field which is in magnetic communication with said rear surface of said planar and rectangular display plate after said planar and rectangular display plate has been positioned within said frame member;

said frame member being further adapted with a closed loop member which may receive either the chain of a necklace or bracelet or the loop of a charm bracelet.

2. Apparatus for securely framing and displaying miniature ornamental or pictorial displays within small items of jewelry described in claim 1 in which a miniature ornamental or pictorial display may be applied directly upon said display plate front surface.

3. Apparatus for securely framing and displaying miniature ornamental or pictorial displays within small items of jewelry described in claim 1 in which a miniature ornamental or pictorial display may be applied directly upon said display plate front surface and which said miniature ornamental or pictorial display can be further protected by use of a clear coat finish applied to said miniature ornamental or pictorial display.

4. Apparatus for securely framing and displaying miniature ornamental or pictorial displays within small items of jewelry, the apparatus comprising;

a planar and rectangular display plate, said planar display plate having a front surface upon which an ornamental or pictorial display may be fixed and a rear surface, said rear surface comprised of and exposing a material which is reactive with and attracted to a magnetic field, said planar and rectangular display plate being further adapted with corresponding and oppositely disposed left and right sides and corresponding and oppositely disposed upper and lower sides;

a frame member, said frame member further generally defining two corresponding and oppositely disposed left and right frame member sides and a frame member base, said frame member sides being positioned and shaped to permit the said left and right sides of said planar and rectangular display plate to be snugly slid within frame member side channels along the length of each said frame member side from outside the frame member to a point within the frame member so that said lower side of said display plate rests against said frame member base and said left and right sides of said display plate are held in position by said frame member sides;

said frame member being further adapted with an open front portion, said open front portion being adapted to permit the viewing of the said front surface of said planar and rectangular display plate and being adapted with a mounting member, said mounting member being adapted with a source of magnetic radiation positioned so as to create a magnetic field which is in magnetic communication with said rear surface of said planar and rectangular display plate after said planar and rectangular display plate has been positioned within said frame member;

said frame member being further adapted with a closed loop member which may receive either the chain of a necklace or bracelet or the loop of a charm bracelet.

5. Apparatus for securely framing and displaying miniature ornamental or pictorial displays within small items of jewelry described in claim 4 in which a miniature ornamental or pictorial display may be applied directly upon said display plate front surface.

6. Apparatus for securely framing and displaying miniature ornamental or pictorial displays within small items of jewelry described in claim 4 in which a miniature ornamental or pictorial display may be applied directly upon said display plate front surface and which said miniature ornamental or pictorial display can be further protected by use of a clear coat finish applied to said miniature ornamental or pictorial display.

7. Apparatus for securely framing and displaying miniature ornamental or pictorial displays within small items of jewelry, the apparatus comprising;

a planar display plate, said planar display plate having a front surface upon which an ornamental or pictorial display may be fixed and a rear surface, said rear surface comprised of and exposing a material which is reactive with and attracted to a magnetic field, said display plate being further adapted with corresponding and oppositely disposed left and right sides and corresponding and oppositely disposed upper and lower sides;

a frame member, said frame member further generally defining two corresponding and oppositely disposed left and right frame sides and a frame base, said frame sides being positioned and shaped to permit the said left and right sides of said display plate to be snugly slid within frame member side channels along the length of each said frame sides from outside the frame member to a point within the frame member so that said lower side of said display plate rests against said frame base and said left and right sides of said display plate are held in position within said frame member by said frame sides;

said frame member being further adapted with an open front portion, said open front portion being adapted to permit the viewing of the said front surface of said planar display plate and being adapted with a mounting member, said mounting member being adapted with a source of magnetic radiation positioned so as to create a magnetic field which is in magnetic communication with said rear surface of said planar display plate after said planar display plate has been positioned within said frame member;

said frame member being further mounted upon the exposed portion of either a bracelet, belt buckle, or jewelry ring.

8. Apparatus for securely framing and displaying miniature ornamental or pictorial displays within small items of jewelry described in claim 7 in which a miniature ornamental or pictorial display may be directly applied upon a display plate front surface.

9. Apparatus for securely framing and displaying miniature ornamental or pictorial displays within small items of jewelry described in claim 7 in which a miniature ornamental or pictorial display may be directly applied upon said display plate front surface and which said miniature ornamental or pictorial display can be further protected by use of a clear coat finish applied to said miniature ornamental or pictorial display.

* * * * *